United States Patent [19]

Carlson

[11] 4,437,326

[45] Mar. 20, 1984

[54] BULGE FORMING METHOD AND APPARATUS

[76] Inventor: Arne H. Carlson, 2202 "A" St., Tacoma, Wash. 98402

[21] Appl. No.: 385,838

[22] Filed: Jun. 7, 1982

[51] Int. Cl.[3] ..... B21D 22/10

[52] U.S. Cl. ..... 72/62; 72/364

[58] Field of Search ..... 72/342, 364, 58, 59, 72/61, 62; 164/106; 29/421 R

[56] References Cited

U.S. PATENT DOCUMENTS

| | | | |
|---|---|---|---|
| 1,111,198 | 9/1914 | Wacker . | |
| 1,234,586 | 7/1917 | Wacker . | |
| 3,274,813 | 9/1966 | Aleck | 72/62 |
| 3,572,073 | 3/1971 | Dean | 72/62 |
| 3,584,487 | 6/1971 | Carlson | 72/38 |
| 3,605,477 | 9/1971 | Carlson | 72/342 |
| 3,934,441 | 1/1976 | Hamilton et al. | 72/342 |
| 3,974,673 | 8/1976 | Fosness et al. | 72/38 |
| 4,145,903 | 3/1979 | Leach et al. | 72/342 |

FOREIGN PATENT DOCUMENTS

| | | | |
|---|---|---|---|
| 1608775 | 9/1969 | Fed. Rep. of Germany | 164/106 |

*Primary Examiner*—Leon Gilden

*Attorney, Agent, or Firm*—Delbert J. Barnard

[57] ABSTRACT

An annular workpiece (114), in blank form, is snugly received within a central opening portion of an annular die member (78) having a radially inwardly directed die face. The two ends of the workpiece make sealing contact with radially inwardly sloping outer sidewall portions (118) of annular seal grooves (116) formed in support members (36, 54) for the two ends of the workpiece (114). The support members (36, 54) and the annular die member (78) are heated, by the use of induction heating apparatus (38, 42, 80, 100, 102, 52, 54), while a molten metal is pressure fed into the interior of the workpiece. The molten metal is pressurized while it is within the workpiece and it functions to both heat the workpiece and press it radially outwardly into forming contact with the die face. As the workpiece is being stretched in this manner and is taking the shape of the die face, the two end support members (36, 54) are being moved relatively together. As such members (36, 54) move, the end portions of the workpiece are turned inwardly by, and slide relatively along, the radially inwardly sloping outer surfaces (118) of the seal grooves (116). The pressure within the workpiece acts on inwardly turning lips being formed at the ends of the workpiece, pressing them radially outwardly into tight sealing contact with the sloping surfaces (118) of the grooves (116). Induction heating (64, 124) is used for heating the molten metal while it is within a storage vessel (64) and also while it is inside the workpiece (38, 42).

31 Claims, 6 Drawing Figures

BULGE FORMING METHOD AND APPARATUS

DESCRIPTION

1. Technical Field

This invention relates to the provision of a bulge forming method and apparatus for forming annular parts from one piece annular blanks of difficult to form materials such as titanium alloys and the like.

2. Background Art

Cold bulge forming of parts from annular blanks is a known art. Examples of known cold bulge forming methods and apparatus are disclosed by U.S. Pat. No. 1,111,198, granted Sept. 22, 1914 to Frederick G. Wacker, and by U.S. Pat. No. 1,234,586, granted July 24, 1917, also to Frederick G. Wacker. Specific uses of induction heating for draw forming difficult to form materials, such as titanium alloys and the like, are disclosed by my prior U.S. Pat. Nos. 3,584,487, granted June 15, 1971, and 3,605,477, granted Sept. 20, 1971.

U.S. Pat. No. 3,274,813, granted Sept. 27, 1966, to Benjamin J. Aleck discloses a method and apparatus for bulge or stretch forming high tensile strength pressure vessels at very low temperatures. The stretching force is applied by a low temperature refrigerant which is introduced into the vessel. The region around the vessel is also refrigerated during the stretching operation.

U.S. Pat. No. 3,572,073, granted Mar. 23, 1971, to Walter B. Dean, discloses a method and apparatus for stretch forming a closed vessel while it is being heated. The vessel is filled with a gas and placed within a mold. The mold assembly is then put into an oven where it is heated to approximately 1,200 degrees F. The heat causes the gas to expand and apply pressure on the walls of the vessel, forcing the walls radially outwardly into forming contact with a surrounding die face.

U.S. Pat. No. 3,974,673, granted Aug. 17, 1976, to John P. Fosness and Louis Odor, discloses a method and apparatus for hot forming titanium alloy sheet material. The periphery of the sheet material is clamped between two sections of a hot-form chamber. An electrical resistance radiant heating apparatus is located in one section of the chamber and is operated to heat the clamped sheet metal blank while a die member located in the other section of the chamber is being moved into forming contact with the heated blank.

All of the above patents, and the various reference patents cited in them, should be carefully considered for the purpose of putting the present invention into proper perspective relative to the prior art.

The method and apparatus for forming parts from difficult to form materials, such as titanium alloys and the like, which are disclosed by my aforementioned U.S. Pat. Nos. 3,584,487 and 3,605,477 have proven to be very successful. However, it is only possible to manufacture "barrel" shaped annular parts by use of such method and apparatus, by forming sections of the parts and then welding the sections together. In this context, the term "barrel" shaped angular part is used to mean a part which has a diameter between its ends which is larger than the diameters at its ends.

As stated above, the method and apparatus disclosed by my aforementioned U.S. Pat. Nos. 3,605,477 and 3,584,487 can be used very successfully for making a barrel shaped annular member in sections. However, after each section is formed, it must be machined and carefully fit to the other sections. Then, the sections must be welded together and after they are welded together the welds must be carefully dressed by precision planing or grinding. Then, the entire part must be resized to its specification dimensions. The machining necessary to dress the welds is relatively expensive because such machining is done after the sections have been formed and thus the machining is being performed on curved surfaces.

The principal object of the present invention is to provide a method and apparatus for hot forming "barrel" shapes from a one piece annular blank or workpiece, with weld dressing and resizing of the part being unnecessary, resulting in a substantial decrease in the cost of manufacture of the part.

DISCLOSURE OF THE INVENTION

The bulge forming method and apparatus of the present invention is basically characterized by the use of a molten metal inside of the workpiece for pressing it radially outwardly into forming contact with the die face.

According to a basic aspect of the invention, the apparatus of the invention comprises an annular die means which defines a central opening. The inner surface of the annular die means constitutes a radially inwardly directed annular die face. An annular workpiece is supported within the central opening in close proximity to the annular die face by support means which includes upper and lower support members which contact the upper and lower ends of the workpiece. Molten metal is pressure fed into the workpiece for both heating the workpiece and pressing it radially outwardly into forming contact with the die face.

A principal advantage of this technique is that the annular blank workpiece can be formed by rolling a piece of sheet material into a cylinder and butt welding its two ends together. The weld must be dressed but it is much easier and substantially less expensive to machine a straight weld on the workpiece while it is still in blank form, than it is to machine a plurality of curved welds between formed sections of a formed workpiece.

According to an important aspect of the invention, the annular die means is heated during the forming operation by means of an induction heating coil. In preferred construction, the annular die means comprises an annular support member having a center opening and an annular die member which is removably received within the center opening. The annular die member carries the radially inwardly directed die face.

In accordance with an aspect of the invention, the annular die member is of split construction, enabling it to be removed in sections from the formed workpiece.

In accordance with another aspect of the invention, at least one of the support means is mounted to be moved relatively towards and away from the other support. In preferred form, each of the support members is movable relatively toward and away from the other support member. During the forming operation, the annular die means is held fixed in position and the two support members are moved relatively together and toward the annular die means at a rate necessary to maintain the ends of the workpiece into tight sealing contact with the support members. As the workpiece is formed, it both expands radially and shrinks axially. Thus, it is necessary to move the support members endwise inwardly in order to maintain contact between them and the ends of the workpiece.

In accordance with yet another aspect of the invention, the apparatus includes a reservoir for the molten metal. In preferred form, compressed gas is delivered into the reservoir and used for pressure feeding the molten metal out from the reservoir into a space defined inside the workpiece. In preferred form, induction heating is used for maintaining the molten metal in a molten state while it is in said reservoir. In the preferred embodiment, induction heating is used for maintaining the metal in a molten state while it is inside the workpiece.

In accordance with still another important part of the invention, each support member includes an annular groove defined in part by a radially inwardly sloping outer sidewall against which its end of the annular workpiece makes a sliding sealing contact. As the workpiece is being formed, and the two support members are being moved relatively together, the end portions of the workpiece turn inwardly and slide along said sloping sidewall surfaces, at all times maintaining a tight metal-to-metal sealing contact so that the molten metal within the workpiece will not leak out at the ends of the workpiece. Owing to this construction, the pressure within the end piece will act on the end portions of the workpiece and press them tightly against the sloping sidewall surfaces of the grooves.

In accordance with an aspect of the invention, the inner sidewall of each groove is configured such that no part of it will block an axial movement of the end portion of the workpiece relatively out of the groove. Thus, following forming, the two support members can be moved axially away from the workpiece. In the preferred form, the inner sidewalls of the grooves are simply cylindrical.

These and other inherent objects, features, advantages and characteristics of the present invention will be apparent from the following description of a typical and therefor non-limitive embodiment of the invention, as described below in conjunction with the accompanying illustrations.

BRIEF DESCRIPTION OF THE DRAWINGS

In the drawings, like element designations refer to like parts, and.

DESCRIPTION OF THE PREFERRED EMBODIMENT

Figure 1:
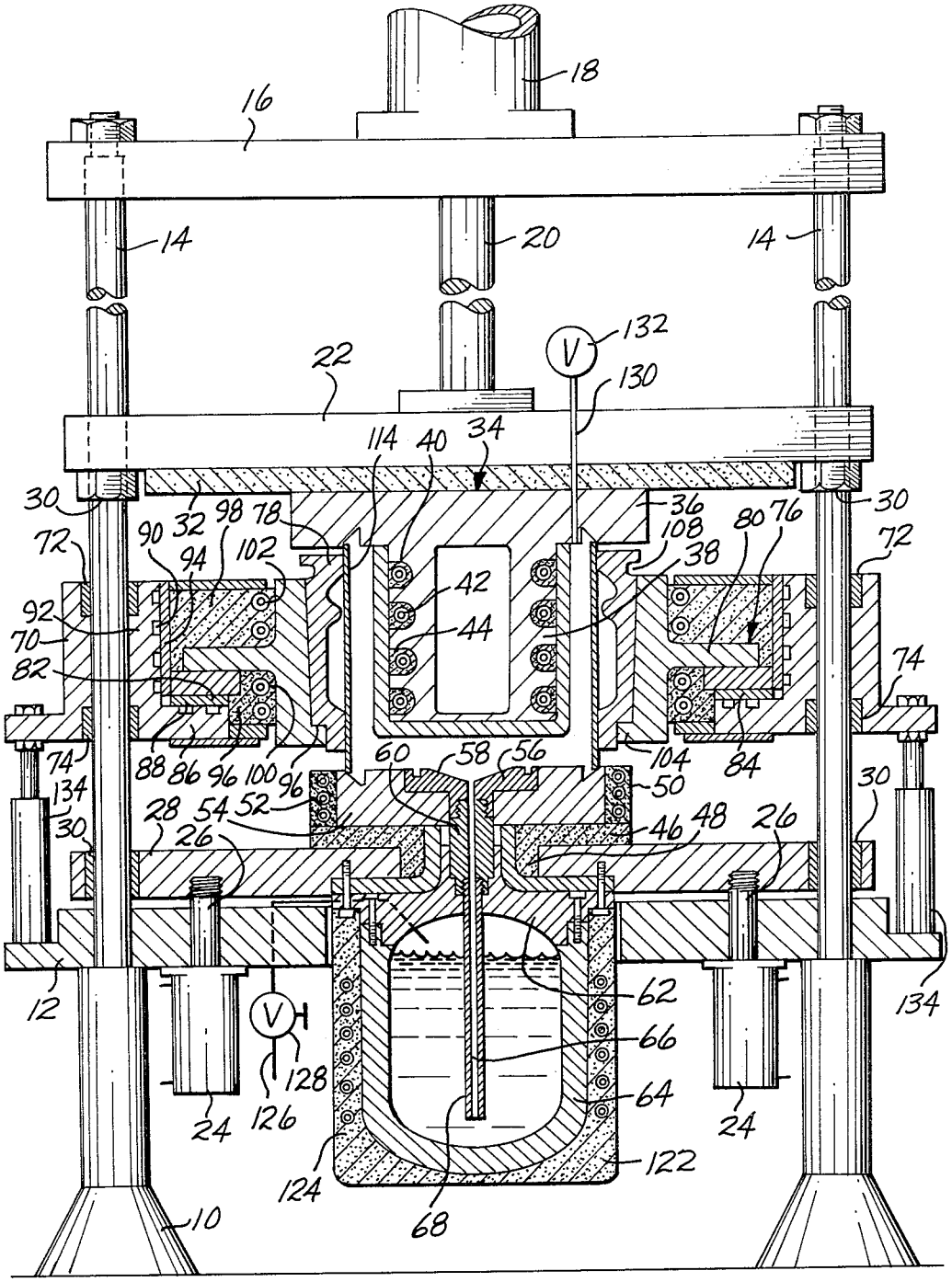
FIG. 1 is a front elevational view of a bulge forming machine constructed in accordance with the present invention, with key components shown in section, said view showing a blank in place prior to the start of the forming operation.
Figure 2:
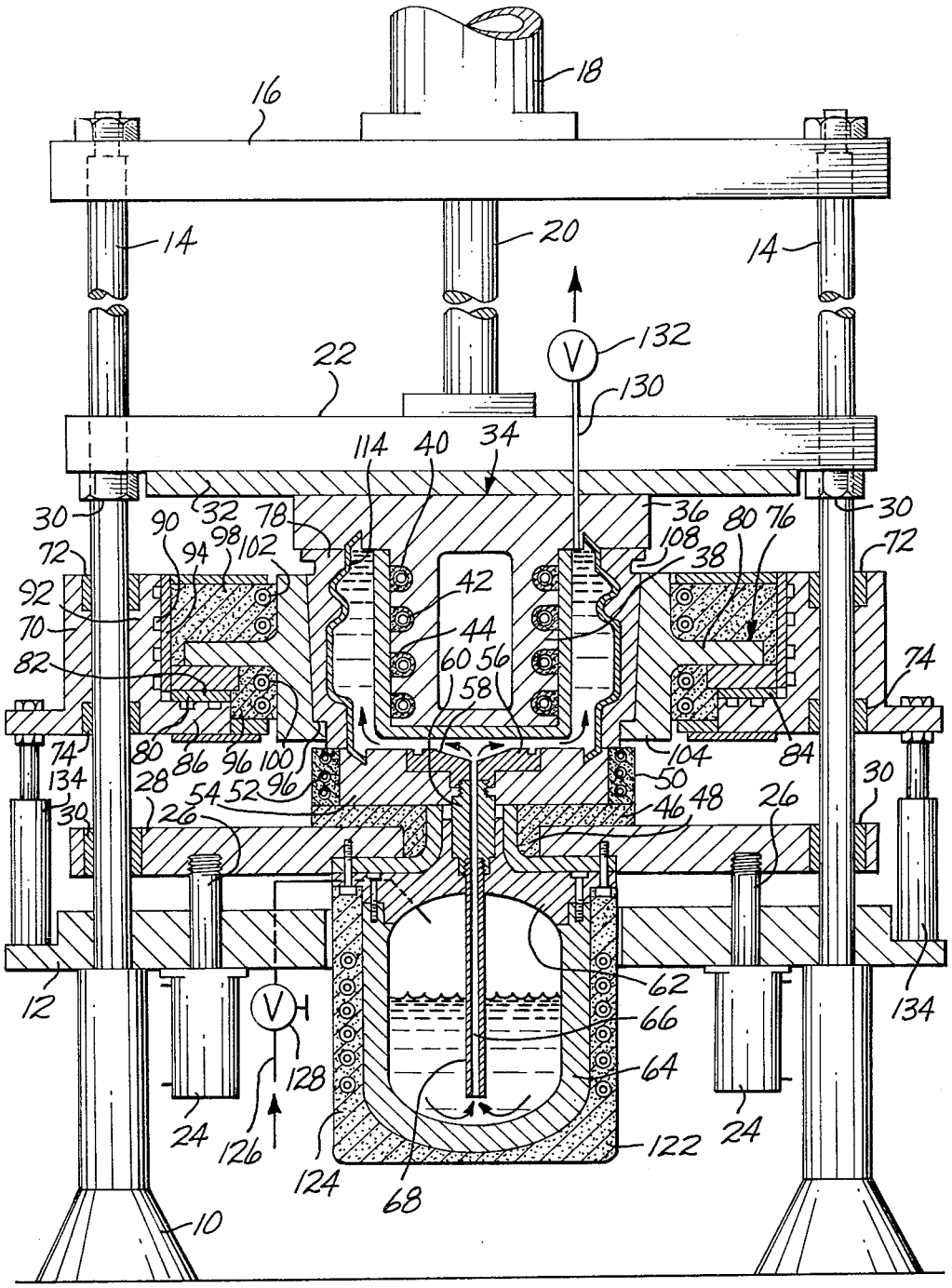
FIG. 2 is a view like FIG. 1, but showing the various components at the completion of the forming operation.

Referring to FIGS. 1 and 2, the forming apparatus of the present invention comprises a frame 10 including an elevated table 12, four columns 14 extending upwardly from the corners of the table 12, and a top member 16 which interconnects the upper ends of the columns 14. A double acting hydraulic cylinder 18 is supported on top member 16. Cylinder 18 includes a downwardly extending piston rod 20 which at its lower end is connected to an upper platen 22. A plurality of double acting hydraulic cylinders 24 are mounted on the table 12. Cylinders 24 include upwardly extending piston rods 26 which connect at their upper ends to a lower platen 28. Platens 22, 28 carry sleeve bearings 30 at their corners which serve to slidably mount the platens 22, 28 onto the columns 14.

Platens 22, 28 are constructed to include water jackets through which cooling water is circulated. By way of typical and therefore nonlimitive example, the water jackets may be constructed in the manner disclosed in the aforementioned U.S. Pat. No. 3,605,477.

A plank 32 of a cast ceramic material, capable of withstanding large compression loads, is secured to the underside of upper platen 22. A metal mass 34 is secured to the central portion of the upper platen 22. It includes a large area top part 36 and a narrower central part 38 which depends from part 36. Circumferential grooves 40 are formed in part 38. Induction heating coils of the type disclosed in aforementioned U.S. Pat. No. 3,605,477 are located within grooves 40. Coils 42 are embedded within a cast ceramic material 44. As shown, member 38 may be hollow.

A second plank 46 of cast ceramic material is secured to the central upper portion of platen 28. It may include a cylindrical extension 48 which projects downwardly into a central opening formed in platen 28. An annular body 50 formed from bulk ceramic material projects upwardly from member 46. Additional induction heating coils 52 are embedded within member 50. A matellic member 54 is positioned on member 46 and within member 50. It includes a central opening sized to receive a pipe fitting 56 having a funnel like upper surface 58. Fitting 56 is connected to a nipple 60, such as by a threaded connection. The lower end of the nipple 60 is connected to the top portion 62 of a storage vessel 64. A central passageway is formed vertically through member 56, nipple 60 and a tube 68 which is connected at its upper end of nipple 60. Passageway 66 communicates the interior of storage vessel 64 with the region above member 58.

A die support frame 70 is positioned vertically between the platens 22, 28. It includes upper and lower bearings 72, 74 at its corners which serve to mount it for sliding movement up and down the columns 14. Member 70 carries a die means which includes an annular die member support 76 and an annular die member 78. Support member 76 includes a radially outwardly projecting flange 80 which rests directly on an annular member 82 formed of cast ceramic material. Member 82, in turn, rests on an annular upper wall 84 of a water jacket portion of member 70. Member 70 is formed to include a radially inwardly projecting wall 86. Grooves 88 are formed in the upper surface of flange 86. Member 82 makes closed passageways out of the grooves 88. In similar fashion, heat jacket grooves 90 are formed in the upstanding outer portion 92 of member 70 and wall means 94 covers the grooves 90 so that they become passageways through which cooling water may be circulated. Cast ceramic material 96 and 98 is provided in the regions below and above the flange 80. Induction heating coils 100, 102 are embedded within the materials 96, 98.

Die member support 76 is formed to include a radially inwardly projecting lower flange 104. Die member 78 is formed to include a shoulder 106 which rests downwardly on flange 104. Die member 78 also includes an upper portion which projects upwardly above member 76. It includes a circumferential groove 108.

Figure 3:
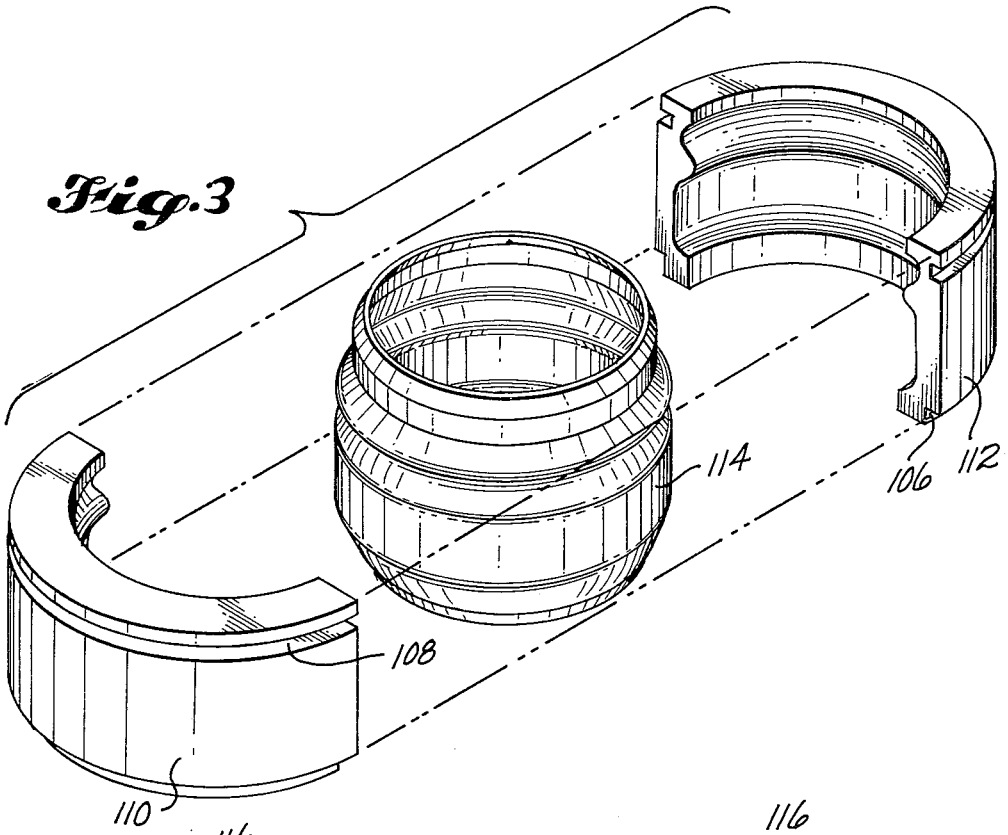
FIG. 3 is an exploded isometric view of the two halves of a sectional die member shown spaced from a formed part.

As best shown in FIG. 3, die member 78 is split into sections. In the preferred embodiment, it is split into two semi-annular sections. In other embodiments, it may be desirable to split it into two full ring portions which are axially joined together. Or, it may be desirable to split it both axially and radially.

Groove 108 is provided to receive portions of a suitable tong like tool or the like which is used for handling the sections 110, 112.

Figure 4:
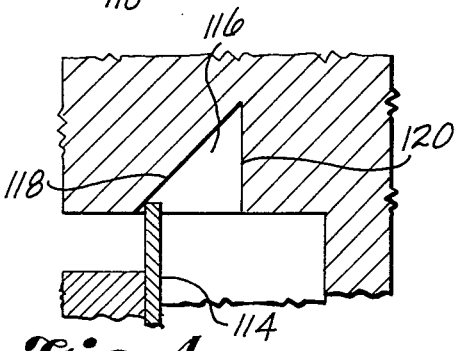
FIG. 4 is an enlarged scale fragmentary view showing sealing contact between one end of the blank and a sloping surface of a recess in a support member, at the start of the forming operation.

A key aspect of the present invention relates to the provision of a suitable means for sealing the upper and lower ends of an annular blank 114 during the forming operation. This seal simply comprises an annular groove formed in each of members 36, 54. Each annular groove 116 includes a sloping outer wall 118 and an axial inner wall 120, or the functional equivalent. The end portions of the annular blank 114 contact the sloping surface 118 in the manner shown by FIG. 4.

Storage vessel 64 is surrounded by a jacket 122 of cast ceramic material in which induction heating coils 124 are embedded. A conduit 126, shown in schematic form, is provided for delivering compressed into the upper portion of vessel 62. Conduit 128 includes a suitable control valve 128 having off-on as well as flow rate capabilities. A vent tube 130 extends upwardly from the space defined radially between member 38 and die member 78. An off-on valve 132 is formed in conduit 130.

Frame member 70 and the components carried thereby are positioned by means of a plurality of double acting hydraulic cylinders 134.

Prior to the start of operation, pieces of a suitable metal, e.g. aluminum, are placed within vessel 64. The induction heating coils 124 are operated to heat the storage vessel 64. It in turn heats the metal pieces until the metal becomes molten or fluid.

With platen 22 is raised, and the die member 78 is fitted within the central socket portion of member 76, a cylindrical blank 114 is set into place within the die member 78. Cylinders 22 are used for raising the lower platen 28 and cylinder 18 is used for lowering the upper platen 22, until about equal end portions of the blank 114 project upwardly and downwardly from the die member 78 and make sealing contact with the sloping surfaces 118 of the seal grooves 116.

Induction heating coils 52 are operated to heat member 54. Induction heating coils 46 are operated to heat member 38. Induction heating coils 100, 102 are operated to heat support member 76 and the die member 78.

Member 38 projects downwardly into the interior of the blank 114, to decrease the volume of the cavity.

Figure 5:
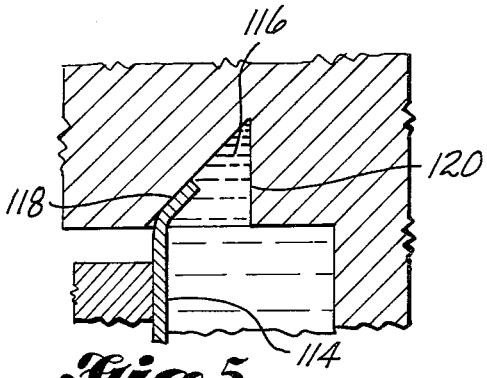
FIG. 5 is a view like FIG. 4, but showing the end of the blank at an intermediate stage of the operation.
Figure 6:
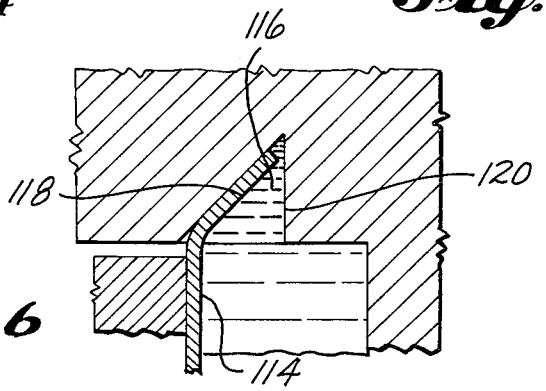
FIG. 6 is a view like FIGS. 4 and 5, but showing the end of the blank at the completion of the forming operation.

While all of the induction heating coils are on, and are heating the various metal members with which they are associated, the valve 128 is opened and compressed air is delivered through the conduit 126 into the upper region of the vessel 74. The compressed air first forces molten metal upwardly through passageway 66 and then pressurizes such metal when it is within cavity 136. The pressurized molten metal presses outwardly on blank 114, pressing it into the cavities and around the ridges which constitute the die face. The cylinders 18, 24 are operated to move the platens 22, 28 relatively together as the material 114 is conforming to the shape of the die face. As shown by FIGS. 5 and 6, the end portions of member 114 are turned inwardly during movement of the platens 22, 28, but tight sealing contact is always maintained between the end portions of member 114 and the seal surface 118. The cylinders 18, 24 are coordinated so that they will move the platens 22, 28 at the same rate, so that both ends of the member 114 are treated substantially the same.

When forming has been completed, i.e. the blank 114 has taken the shape of the die face (FIG. 2), valve 128 is closed and valve 132 is opened. Opening of valve 132 vents the cavity 136 and allows the molten metal to flow back into the storage vessel 64. Following drainage of cavity 136, cylinder 18 is operated to raise platen 22, to withdraw member 36 out from the central region of the die member. Then, tine portions of a suitable lifting tong mechanism (not shown) are inserted into the groove 108 and the mechanism is operated to lift the die member 78 and the form part therein upwardly until they have cleared the upper boundary of member 76. Then, the two parts 110, 112 of die member 78 are separated and the formed part is removed.

Aluminum can be used for the molten metal when the member 114 is a titanium alloy or the like. It is believed that the molten metal should be heated up into the range of 1,000–1,500 degrees F. for titanium. It is further believed that for tatanium, the molten material would have to be pressurized within the range of 300–1,000 psig.

As previously mentioned, one advantage of bulge forming is that the blank can be formed from a single piece of flat sheet material that is rolled into a cylindrical shape and welded together at its ends. Since the material is flat, the weld can be easily and inexpensively machined prior to forming.

As fully described in my aforementioned U.S. Pat. Nos. 3,584,487 and 3,605,477, a transformer (not shown) is associated with, and its output is connected to, each of the induction heating coils 45, 52, 100, 102, 124. The metallic masses 38, 78, 80, 54 and 64 are ferromagnetic materials. The die member 78 is constructed from a metal capable of maintaining a hardwear surface at elevated temperatures. Examples of such metals are stainless steel 321, stainless steel 347, Hasteloy X. Inconel 750 and Inconel 820, each of which is a non-magnetic material. The electrical energy conducted to the conductor coils 42, 52, 100, 102, 124 does not directly heat such coils, as is the case with the resistance heater elements, but rather inductively heats the magnetic cores 38, 80, 54, 64. Since the conductors 42, 52, 100, 102, 124 are closely adjacent the conductively heated cores 38, 54, 64, 80, they are susceptible to being heated by the conduction of heat back from such cores. The conductors 42, 52, 100, 102, 124 are protected from such heat to some extent by the insolative material in which they are embedded. However, the conductors 42, 52, 100, 102, 124 are made of tubular form and a cooling liquid, e.g. water, is directed through them for removing the heat that does come back from the electromagnetic material.

Reference is made to my aforementioned U.S. Pat. Nos. 3,584,487 and 3,605,477 for a discussion relating to the sequence of steps shown in FIG. 1 of such patents. This manner of handling the piece may be employed in conjunction with the techniques of the present invention.

I claim:

1. Bulge forming apparatus, comprising:

annular die means defining a central opening and presenting a radially inwardly directed annular die face;

support means for supporting an annular workpiece within said central opening, in close proximity to said annular die face including upper and lower support members for contacting upper and lower ends of the workpiece; and means for pressure feeding molten metal into the workpiece, for both heating the workpiece and pressing it radially outwardly into forming contact with the die face, to conform the workpiece to the shape of the die face.

2. Bulge forming apparatus according to claim 1, comprising means for heating the annular die means.

3. Bulge forming apparatus according to claim 2, wherein the means for heating the annular die means comprises an induction heating coil surrounding said annular die means, said induction heating coil in use inductively heating said annular die means and said annular die means conductively heating the workpiece.

4. Bulge forming apparatus according to claim 3, wherein said annular die means comprises an annular support member having a center opening and an annular die member removably received within the center opening, said annular die member including the radially inwardly directed die face.

5. Bulge forming apparatus according to claim 4, wherein said annular die member is of split construction, enabling it to be removed in sections from the formed workpiece.

6. Bulge forming apparatus according any of claims 1–5, comprising means for moving at least one of said support member relatively towards and away from the other support member.

7. Bulge forming apparatus according to any of claims 1–5, comprising means for moving each support member towards and away from the other support member.

8. Bulge forming apparatus according to any of claims 1–5, further comprising means for heating the molten metal while the molten metal is inside the workpiece.

9. Bulge forming apparatus according to claim 8, wherein the means for heating the molten metal while the molten metal is inside of the workpiece comprises a metallic means inside of the workpiece, in spaced relationship thereto, and induction heating coil means for heating said mass.

10. Bulge forming apparatus according to any of claims 1–5, comprising a reservoir for holding the molten metal, means for transferring molten metal between said reservoir and a space inside of said annular workpiece, and means for heating said molten metal while it is in said reservoir.

11. Bulge forming apparatus according to claim 10, wherein the means for heating the molten metal while it is inside of the reservoir comprises induction heating coil means.

12. Bulge forming apparatus according to claim 11, wherein the induction heating coil means surrounds said reservoir.

13. Bulge forming apparatus according to any of claims 1–5, comprising induction heating coil means for heating each said support member.

14. Bulge forming apparatus according to any of claims 1–5, wherein each support member is formed to include an annular groove that is positioned to receive an end portion of the annular workpiece, each said annular groove including a radially inwardly sloping outer sidewall against which its end of the annular workpiece makes a sliding sealing contact.

15. Bulge forming apparatus according apparatus according to claim 14 wherein said annular groove includes an inner sidewall configured such that no part of it will block an axial movement of the end portion of the workpiece relatively out of said groove.

16. Bulge forming apparatus according to either claim 14 or 15, comprising means for moving at least one of said support means relatively towards and away from the other support means.

17. Bulge forming apparatus according to either claim 14 or 15, comprising means for moving each support means towards and away from the other support means.

18. Bulge forming apparatus, comprising:

annular die means defining a central opening and presently a radially inwardly directed annuar die face;

support means for supporting an annular workpiece within said central opening, in close proximity to said annular die face, including upper and lower support members for contacting upper and lower ends of the workpiece;

each support means being formed to include an annular groove that is positioned to receive an end portion of the annular workpiece, each said annular groove including a radially inwardly sloping outer sidewall against which its end of the annular workpiece makes a sliding sealing contact;

means for moving at least one of the support means relatively towards and away from the other suport means;

means for heating the annular die means;

means for heating each of said support means; and means for pressure feeding molten metal into the workpiece, for both heating the workpiece and pressing it radially outwardly into forming contact with the die face, causing the workpiece to conform to the shape of the die face.

19. Bulge forming apparatus according to claim 18, wherein the means for heating the annular die means comprises an induction heating coil surrounding said annular die means, said induction heating coil inductively heating said annular die means and said annular die means conductively heating the workpiece.

20. Bulge forming apparatus according to claim 19, wherein said annular die means comprises an annular support member having a central opening and an annular die member removably received within the central opening, said annular die member including the radially inwardly directed die face.

21. Bulge forming apparatus according to claim 20, wherein said annular die member is of split construction, enabling it be removed in sections from the formed workpiece.

22. Bulge forming apparatus according to claim 18, further comprising means for heating the molten metal while the molten is inside the workpiece.

23. Bulge forming apparatus according to claim 22, wherein the means for heating the molten metal while the molten metal is inside of the workpiece comprises a metallic means inside of the workpiece, in spaced relationship thereto, and induction heating coil means for heating said mass.

24. Bulge forming apparatus according to claim 18, comprising a reservoir for holding the molten metal, means for transfering molten metal between said reservoir and a space inside of said annular workpiece, and means for heating said molten metal while it is in said reservoir.

25. Bulge forming apparatus according to claim 24, wherein the means for heating the molten metal while it is inside of the resevoir comprises induction heating coil means.

26. A method of bulge forming an annular workpiece, comprising:

supporting an annular blank workpiece concentrically within an annular die member having a radially inwardly directed die face, including by contacting the opposite ends of the blank workpiece with first and second support members;

introducing a molten metal into the interior of the workpiece blank under pressure, causing sid molten metal to press radially outwardly against the workpiece, forcing it outwardly into forming contact with the die face.

27. A bulge forming method according to claim 26, comprising heating said blank workpiece while it is being formed, both inside by the molten metal and outside by heating the annular die member.

28. A bulge forming method according to either claim 26 or 27, comprising heating said first and second support means while forming the workpiece.

29. A bulge forming method according to either claim 26 or 27, further comprising moving at least one of the support members towards the other while forming the workpiece, and maintaining a sealing contact of the ends of the workpiece with said support members during such movement.

30. A bulge forming method according to claim 29, comprising heating said first and second support means while forming the workpiece.

31. A bulge forming method according to claim 29, wherein the ends of the workpiece are maintained in sealing contact with the first and second support members by contacting said ends with radially inwardly sloping annular surfaces carried by said support members, whereby such ends can conform to and slide along said surfaces as the first and second support members become closer together as the workpiece is being formed.

* * * * *

UNITED STATES PATENT AND TRADEMARK OFFICE

CERTIFICATE OF CORRECTION

PATENT NO. : 4,437,326

DATED : March 20, 1984

INVENTOR(S) : Arne H. Carlson

It is certified that error appears in the above-identified patent and that said Letters Patent are hereby corrected as shown below:

Column 6, line 40, "45" should be --42--.

Column 7, line 48, "means" should be --mass--.

Column 8, line 66, "means" should be --mass--.

Column 9, line 20, "sid" should be --said--.

Signed and Sealed this

Second Day of October 1984

[SEAL]

*Attest:*

GERALD J. MOSSINGHOFF

*Attesting Officer*

*Commissioner of Patents and Trademarks*